US006580410B1

(12) United States Patent
Nishimura et al.

(10) Patent No.: US 6,580,410 B1
(45) Date of Patent: Jun. 17, 2003

(54) LIQUID CRYSTAL DISPLAY

(75) Inventors: Masaru Nishimura, Kumamoto (JP); Jun Someya, Tokyo (JP); Hiroshi Ueno, Tokyo (JP)

(73) Assignees: Kabushiki Kaisha Advanced Display, Kumamoto (JP); Mitsubishi Denki Kabushiki Kaisha, Tokyo (JP)

( * ) Notice: Subject to any disclaimer, the term of this patent is extended or adjusted under 35 U.S.C. 154(b) by 151 days.

(21) Appl. No.: 09/664,721

(22) Filed: Sep. 19, 2000

(30) Foreign Application Priority Data

Sep. 27, 1999 (JP) ..... 11-272638
Sep. 4, 2000 (JP) ..... 2000-266629

(51) Int. Cl.[7] ..... G09G 3/36
(52) U.S. Cl. ..... 345/89; 345/88; 345/690
(58) Field of Search ..... 345/87, 88, 89, 345/98, 100, 99, 690, 691, 692, 693

(56) References Cited

U.S. PATENT DOCUMENTS 5,089,812 A * 2/1992 Fuse et al. ..... 345/89
5,119,086 A * 6/1992 Nishioka et al. ..... 345/89
5,677,704 A * 10/1997 Kusano et al. ..... 345/89
6,064,361 A * 5/2000 Akiyama ..... 345/98

* cited by examiner

*Primary Examiner*—Xiao Wu
(74) *Attorney, Agent, or Firm*—McDermott, Will & Emery

(57) ABSTRACT

In a conventional liquid crystal display, for example, a grayscale display characteristic is changed by providing a plurality of grayscale voltage generation circuits which are selected by a selection circuit, which has resulted in a complicated circuit and consequently in a cost increase. A data conversion circuit 8 utilizing algorithm for performing arbitrary data conversion converts digital image data input from the outside and inputs the resultant data to driving circuits 3 through a control signal generation circuit 1. The source driving circuits 3 select one of a plurality of grayscale voltages generated by the grayscale voltage generation circuit 2 based on the converted digital image data and outputs the same to source lines, thereby changing the grayscale display characteristic.

11 Claims, 17 Drawing Sheets

| INPUT DATA | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| CONVERTED DATA | 0 | 3 | 5 | 7 | 9 | 11 | 12 | 12 | 13 | 13 | 14 | 14 | 14 | 15 | 15 | 15 |

| INPUT DATA | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| CONVERTED DATA IN N-TH FRAME | 0 | 3 | 5 | 7 | 9 | 10 | 11 | 12 | 12 | 13 | 13 | 13 | 14 | 14 | 14 | 15 |
| CONVERTED DATA IN (N+1) -TH FRAME | 0 | 3 | 5 | 7 | 9 | 11 | 12 | 12 | 13 | 13 | 13 | 14 | 14 | 14 | 15 | 15 |
| CONVERTED DATA IN (N+2) -TH FRAME | 0 | 3 | 5 | 7 | 9 | 10 | 11 | 12 | 12 | 13 | 14 | 14 | 14 | 15 | 15 | 15 |

LIQUID CRYSTAL DISPLAY

BACKGROUND OF THE INVENTION

1. Field of the Invention

The present invention relates to a liquid crystal display used for a display screen of a computer and the like.

2. Description of the Related Art

FIG. 15 is a circuit diagram of a conventional liquid crystal display which includes a control signal generation circuit 1, a grayscale voltage generation circuit 2, source driving circuits 3, gate driving circuits 4, a liquid crystal panel 5 and TFTs 6. The liquid crystal panel 5 has a plurality of source lines 5*a* and a plurality of gate lines 5*b*. The control signal generation circuit 1 receives color signal inputs Ri, Gi and Bi, a clock input CLKi and a synchronization signal input Synci and provides color signal outputs Ro, Go and Bo, a clock output CLKo and a synchronization signal output Synco. For example, each of the color signal inputs Ri, Gi and Bi and color signal outputs Ro, Go and Bo is constituted by four bits and is illustrated with an indication "<3;0>" to represent the four bits. "<3;0>" represents four bits from a third bit through a 0-th bit. The grayscale voltage generation circuit 2 generates grayscale voltages Vref. The source driving circuits 3 drive the source lines 5*a* in accordance with the color signal outputs Ro, Go and Bo from the control signal generation circuit 1 and the grayscale voltages Vref from the grayscale voltage generation circuit 2. The gate driving circuits 5 drive the gate lines 5*b* in accordance with the synchronization signal output Synco from the control signal generation circuit 1. The liquid crystal panel 5 has the multiplicity of TFTs 6 in the form of a matrix which are connected to each of the plurality of gate lines 5*b* and the plurality of source lines 5*a* provided in an intersecting relationship with the gate lines 5*b*.

FIG. 16 is a characteristic diagram showing the relationship between the grayscale voltages and luminance of the conventional liquid crystal display, and a characteristic A0 represents the relationship between the grayscale voltages Vref from the grayscale voltage generation circuit 2 and the luminance of the liquid crystal panel 5. FIG. 17 is a characteristic diagram showing the relationship between grayscale data and the grayscale voltages of the conventional liquid crystal display, and a characteristic BO represents the relationship between grayscale data represented by the color signal outputs Ro, Bo and Go from the control signal generation circuit 1 and the grayscale voltages Vref. In this example, each of the color signal outputs Ro, Go and Bo is constituted by four bits, and the 4-bit configuration provides 16 types of grayscale data and the grayscale voltage Vref at 16 levels associated therewith. FIG. 18 is a characteristic diagram showing the relationship between the grayscale data and the luminance of the liquid crystal panel of the conventional liquid crystal display, and a characteristic C0 represents such a relationship.

FIG. 19 is a characteristic diagram showing an example of a modification of the relationship between the grayscale data and luminance of the conventional liquid crystal display, in which the characteristic C0 is changed to a characteristic C1 or C2. FIG. 20 is a characteristic diagram-showing the relationship between the grayscale data and grayscale voltages of the conventional liquid crystal display and, for example, it shows the relationship between the grayscale data and grayscale voltage Vref when the characteristic B0 is changed to a characteristic B1.

FIG. 21 shows another example of a conventional liquid crystal display which includes a plurality of grayscale voltage generation circuits 2*a*, 2*b* and 2*c*.

Referring to FIG. 21, the parts represented by the reference number 1 and the reference numbers 3 through 6 are identical to those in FIG. 15. The grayscale voltage generation circuit 2 includes three grayscale voltage generation circuits 2*a*, 2*b* and 2*c* for changing the relationship between the grayscale voltage and luminance of the liquid crystal display. Reference number 7 represents a selection circuit which selects one of the outputs of the plurality of grayscale voltage generation circuits 2*a*, 2*b* and 2*c*.

In the conventional liquid crystal display as shown in FIG. 15, in order to achieve multi-level color display, grayscale voltages at predetermined levels are selected from among grayscale voltages at a plurality of levels generated by the grayscale voltage generation circuit 2 based on input digital image data; the grayscale voltages are supplied to the TFTs 6 at the liquid crystal panel 6 through the source driving circuits 3; and an image is displayed by applying the grayscale voltages to the liquid crystal.

For example, in the case of a normally white liquid crystal, an increase in the grayscale voltage applied to the liquid crystal results in a reduction in luminance as indicated by the characteristic A0 in FIG. 16. The grayscale data are digital data, and the grayscale voltages are selected on a digital basis.

FIG. 17 represents the relationship between grayscale data at 16 levels and grayscale voltages as the characteristic B0 in order to provide a simple description of the selection of grayscale voltages on a digital basis. The grayscale voltage generation circuit 2 generates grayscale signals V0 through V15 which are selected based on grayscale data. As a result, the grayscale display characteristic C0 shown in FIG. 18 is provided which is represented by a grayscale data-luminance curve.

FIG. 18 omits representation on a digital basis and schematically shows a grayscale display characteristic relative to input grayscale data.

Most conventional liquid crystal displays have a fixed grayscale display characteristic. However, there is a need for a capability of arbitrarily changing the grayscale display characteristic of a display as shown in FIG. 19 to achieve optimum display in accordance with the preference of the user of the display and the environment in which the display is used.

In the case of a liquid crystal display in which grayscale voltages are selected based on digital data, however, the grayscale voltages must be changed, for example, as shown in FIG. 20, which results in a need for a complicated analog circuit for generating the voltages.

Further, a plurality of grayscale voltage generation circuits 2 may be provided to allow grayscale display characteristics to be changed based on selection at a selection circuit 7, as shown in FIG. 21. However, this also results in a complicated circuit and can increase the cost.

The invention was made in order to solve the above-described problems, and it is an object of the invention to provide a liquid crystal display whose grayscale display characteristic can be arbitrarily changed to achieve optimum display in accordance with the preference of the user and the environment in which the display is used.

SUMMARY OF THE INVENTION

A liquid crystal display according to the invention has: a circuit which includes a data conversion circuit for converting digital image input data based on arbitrary algorithm and which outputs digital image output data based on the output of the data conversion circuit; a grayscale voltage generation circuit which outputs grayscale voltages at a plurality of levels; source driving circuits which receive the digital image output data and grayscale voltages and which select and output a grayscale voltage at one level from among the grayscale voltages in accordance with the digital image output data; and a display portion which is configured so as to display an image as a result of the application of the grayscale voltage output by the source driving circuits to a liquid crystal thereof. The data conversion circuit converts the digital image input data so as to change a grayscale display characteristic of the image displayed at the display portion.

There may be provided a plurality,of algorithm defining circuits each of which defines algorithm to be used in the data conversion circuit, and one of the plurality of algorithm defining circuits is selected and used by the data conversion circuit.

A liquid crystal display according to the invention has: a setting portion in which algorithm for converting first digital image data input from the outside into second digital image data is set; a data conversion circuit which uses the algorithm set in the setting portion to convert the first digital image data into the second digital image data; a control signal generation circuit to which the second digital image data converted by the data conversion circuit are input and which outputs the second digital image data and a control signal; a grayscale voltage generation circuit which outputs grayscale voltages at a plurality of levels; source driving circuits to which the second digital image data and control signal output by the control signal generation circuit and the grayscale voltages at a plurality of levels output by the grayscale voltage generation circuit are input, which select a grayscale voltage at one level from among the grayscale voltages at a plurality of levels in accordance with the second digital image data and which output the same in accordance with the control signal; and a display portion which is configured so as to display an image as a result of the application of the grayscale voltage output by the source driving circuits to a liquid crystal thereof. The data conversion circuit converts the first digital image data into the second digital image data so as to change a grayscale display characteristic of the image displayed at the display portion.

A plurality of items of algorithm may be set in the setting portion, and the data conversion circuit may select one of the plurality of items of algorithm to perform data conversion.

Further, the setting portion may be configured so as to allow rewriting of the algorithm from the outside.

Furthermore, the data conversion circuit may convert data in each frame or each group consisting of a plurality of frames.

The digital image data may be constituted by red, green and blue color signals, and the data conversion circuit may perform data conversion on each of the red, green and blue color signals.

In addition, the data conversion circuit may be incorporated in an integrated circuit that constitutes the control signal generation circuit.

DETAILED DESCRIPTION OF THE PREFERRED EMBODIMENTS

Preferred embodiments of the invention will now be described with reference to the drawings.

First Embodiment

Figure 1:
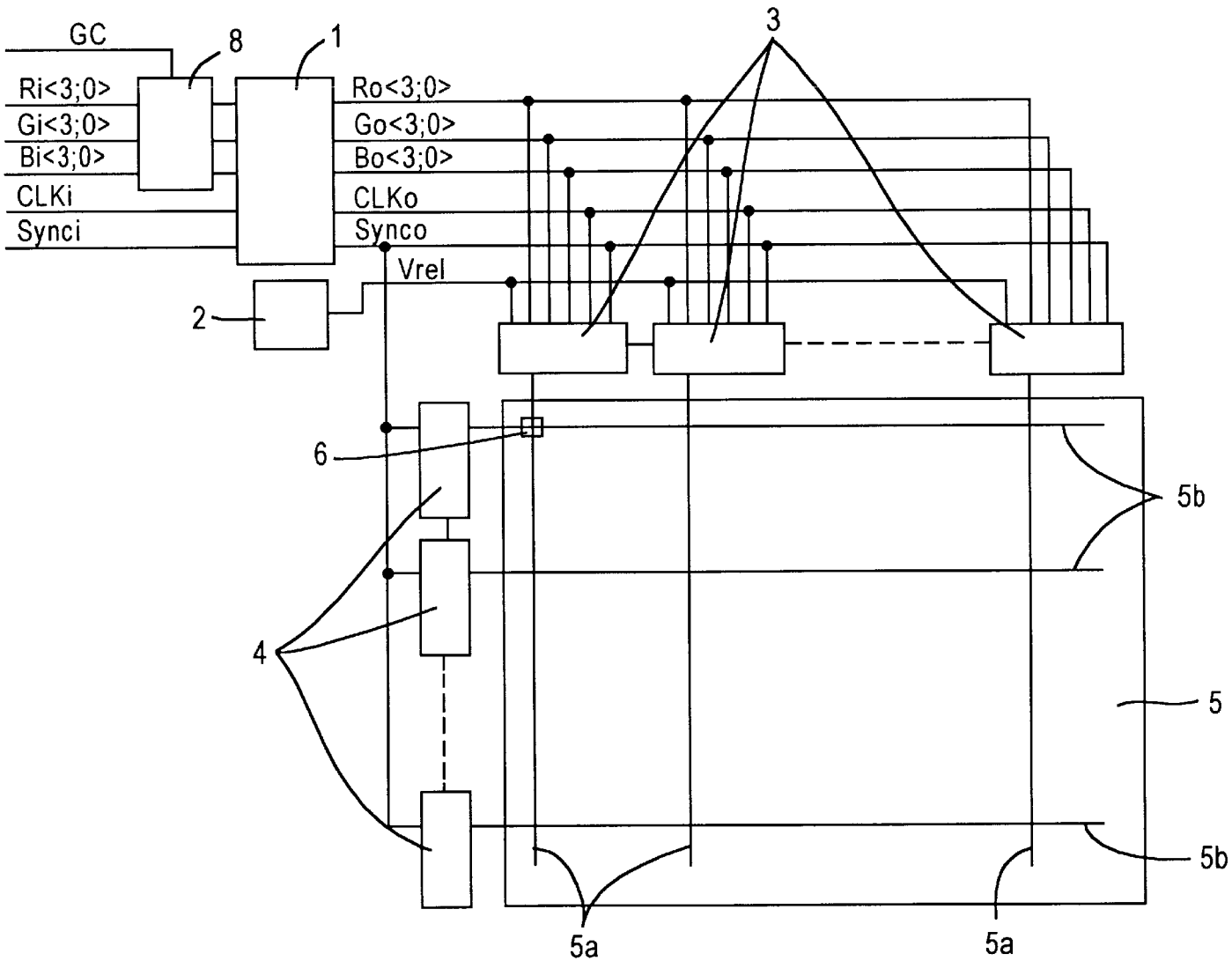
FIG. 1 is a circuit diagram of a liquid crystal display according to a first embodiment of the invention.

FIG. 1 is a circuit diagram of a liquid crystal display according to a first embodiment of the invention. The first embodiment includes a control signal generation circuit 1, a grayscale voltage generation circuit 2, source driving circuits 3, gate driving circuits 4, a liquid crystal panel 5, TFTs 6 and data conversion circuit 8. The liquid crystal panel 5 has a plurality of source lines 5*a* and a plurality of gate lines 5*b*. The control signal generation circuit 1 receives converted outputs ri, bi and gi which are results of conversion of color signal inputs Ri, Gi and Bi from the outside performed by the data conversion circuit 8, a clock input CLKi and a synchronization signal input Synci and provides color signal outputs Ro, Go and Bo, a clock output CLKo and a synchronization signal output Synco. The color signal inputs Ri, Gi and Bi are red, green and blue color signals which are digital signals constituted by a plurality of bits, e.g., four, eight or sixteen bits. In the present embodiment, an example of a 4-bit configuration will be described in order to simplify the description. An indication "<3;0>" will be shown to represent each of such 4-bit configurations. "<3;0>" represents four bits from a third bit through a 0-th bit. While the color signals ri, gi and bi are output as they are as signals Ro, Bo and Go respectively in this example, they may be changed if necessary.

The control signal generation circuit 1 generates output signals for controlling the driving circuits 3 and 4 based on the converted color signals, clock CLKi and synchronization signal Synco input thereto to adjust the output timing of input signals to the source driving circuits 3 and gate driving circuit 4 which generate signals required for displaying an image on the liquid crystal panel 5 and to generate any missing signal. The output signals include the clock output CLKo and synchronization output Synco in addition to the color signal outputs Ro, Bo and Go.

The grayscale voltage generation circuit 2 generates grayscale voltages Vref and supplies them to the source driving circuits 3. The source driving circuits 3 receive the grayscale voltages Vref in addition to the color signal outputs Ro, Bo and Go, clock output CLKo and synchronization output Synco and supply source driving voltages to the source lines 5*a*. The color signal outputs Ro, Bo and Go are digital signals constituted by, for example, four bits similarly to the color signal inputs Ri, Bi and Gi, and each of the 4-bit color signal outputs Ro, Bo and Go is converted into an analog signal which is supplied to the source lines 5*a* as a source driving voltage. When the color signal outputs Ro, Bo and Go are constituted by four bits, the grayscale voltage generation circuit 2 is configured so as to generate grayscale voltages at 16 levels, and grayscale voltages at levels in accordance with the 4-bit color signal outputs Ro, Bo and Go are selected as source driving voltages.

The gate driving circuits 4 receive the synchronization signal output Synco from the control signal generation circuit 1 and sequentially drive the gate lines 5*b* at necessary timing. The TFTs 6 are connected to each of the plurality of gate lines 5*b* and the plurality of source lines 5*a* provided in an intersecting relationship with the gate lines 5*b* and are provided in the form of a matrix.

Figure 2:
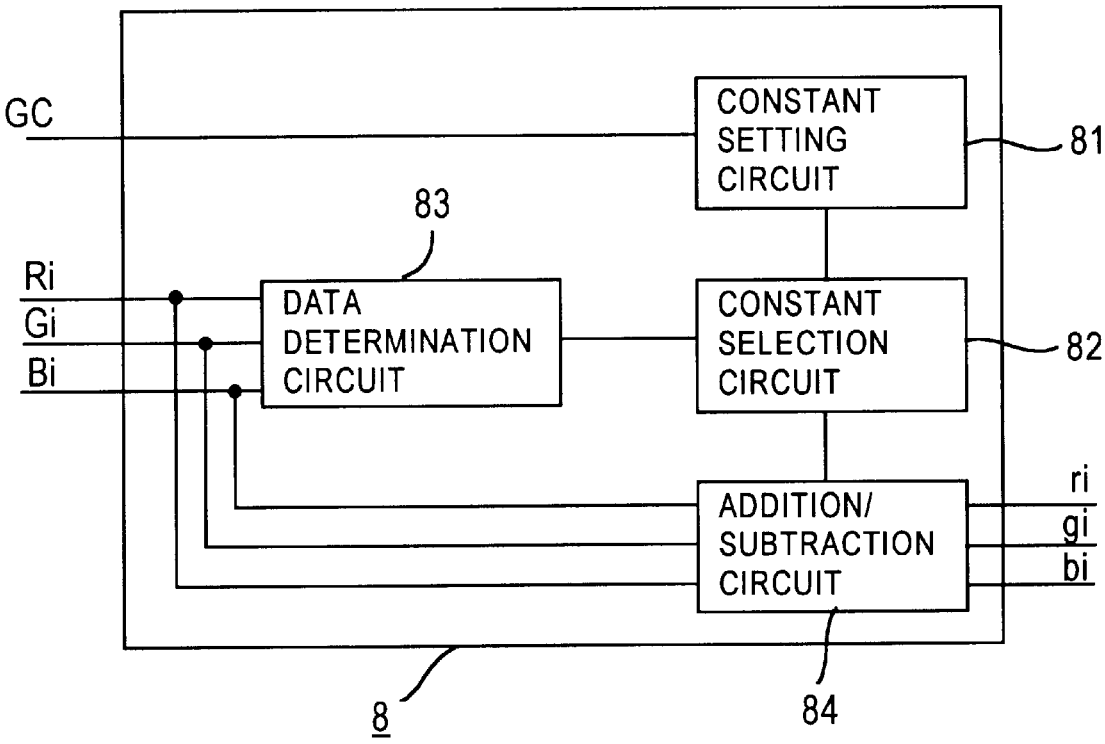
FIG. 2 is a block diagram of a specific example of a data conversion circuit according to the first embodiment.

The data conversion circuit 8 converts the color signal inputs Ri, Bi and Gi according to arbitrary algorithm and supplies converted color signals to the control signal generation circuit 1. FIG. 2 is a block diagram of a specific example of the data conversion circuit 8. The data conversion circuit 8 receives the color signal inputs Ri, Bi and Gi which are digital signals and outputs the converted color signals ri, bi and gi which are digital signals. The data conversion circuit 8 has a constant setting circuit 81, a constant selection circuit 82, a data determination circuit 83 and an addition/subtraction circuit 84.

A register is provided in the constant setting circuit 81, and arithmetic constants are set in the register to allow the color signal inputs Ri, Bi and Gi to be converted by preset arbitrary algorithm. The arithmetic constants thus set are selected by the constant selection circuit 82. The data determination circuit 83 is constituted by, for example, sixteen comparators. Sixteen types of 4-bit digital signals are supplied to the sixteen comparators, and the color signal inputs Ri, Bi and Gi are compared at the comparators to recognize the contents of the digital signals. Arithmetic constants are accordingly selected by the constant selection circuit 82 and are supplied to the addition/subtraction circuit 84. The addition/subtraction circuit 84 respectively adds or subtracts the constants supplied by the constant selection circuit 82 to or from the color signal inputs Ri, Bi and Gi input thereto to output the converted color signals ri, bi and gi. A control signal GC (Gray Cont) supplied to the constant setting circuit 81 is a signal which changes the algorithm of the constant setting circuit 81 to change the contents of the conversion of the color signals Ri, Bi and Gi into the color signals ri, bi and gi.

Figures 3, 4:
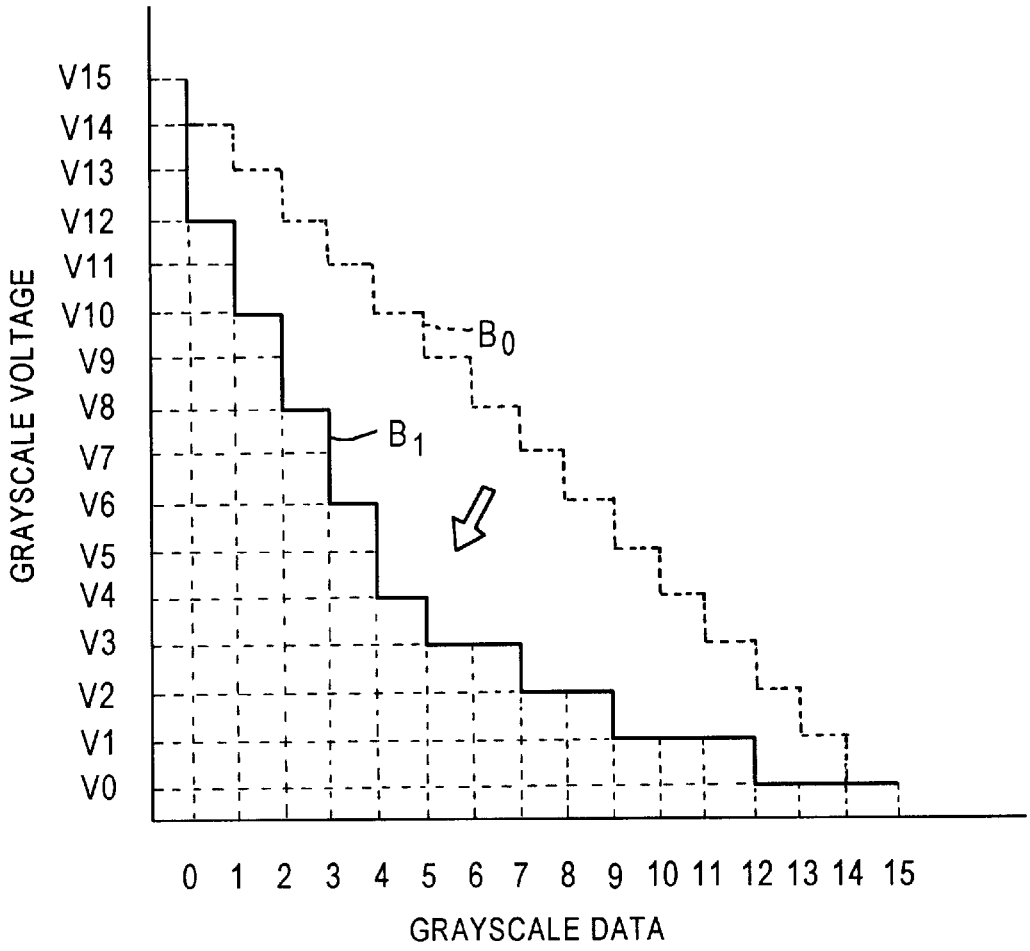
FIG. 3 is a data conversion table showing data conversion performed in the liquid crystal display according to the first embodiment of the invention.
FIG. 4 is a characteristic diagram showing the relationship between grayscale data and grayscale voltages of the liquid crystal display according to the first embodiment of the invention.

FIG. 3 is a data conversion table showing data conversion performed in the liquid crystal display according to the first embodiment of the invention. While sixteen types of input data 0 through 15 represented by the color signal inputs Ri, Bi and Gi which are 4-bit digital signals are converted into the converted color signals ri, bi and gi which are also 4-bit digital signals, in the present embodiment, 2 is added to the input data 1, and 3, 4, 5, 6, 6, 5, 5, 6, 4, 3, 2, 2 and 1 are similarly added to the input data 2, 3, 4, 5, 6, 7, 8, 9, 10, 11, 12, 13 and 14, respectively. FIG. 4 is a characteristic diagram showing the relationship between grayscale data and the grayscale voltages Vref of the liquid crystal display according to the first embodiment of the invention, in which how an original characteristic B0 has been changed to a converted characteristic B1 as a result of the conversion shown in FIG. 2.

In the liquid crystal display having such a configuration, predetermined grayscale voltages are selected from among the plurality of grayscale voltages generated by the grayscale voltage generation circuit 2 based on the digital image data Go, Bo and Go output by the control signal generation circuit 1, and the grayscale voltages are supplied through the source driving circuits 3 to the TFTs 6 at the liquid crystal panel 5 and are applied to the liquid crystal thereof to display an image.

In order to change a grayscale display characteristic, the data conversion circuit 8 is provided to perform arbitrary data conversion on the digital image data Ri, Bi and Gi input from the outside to obtain the digital image data ri, bi and gi, thereby changing the grayscale voltages selected at the source driving circuits 3.

FIG. 3 is a data conversion table showing such data conversion in which data conversion is performed according to arbitrary algorithm on input data which are digital image data input from the outside. For example, as the arbitrary algorithm, a monotone function may be used or, alternatively, representative points of a straight line or curved line may be interpolated.

Data conversion is performed according to the arbitrary algorithm on the grayscale data input from the outside to change the selection of the grayscale voltages as shown in FIG. 4, which changes the grayscale display characteristic.

Second Embodiment

Figures 5, 6:
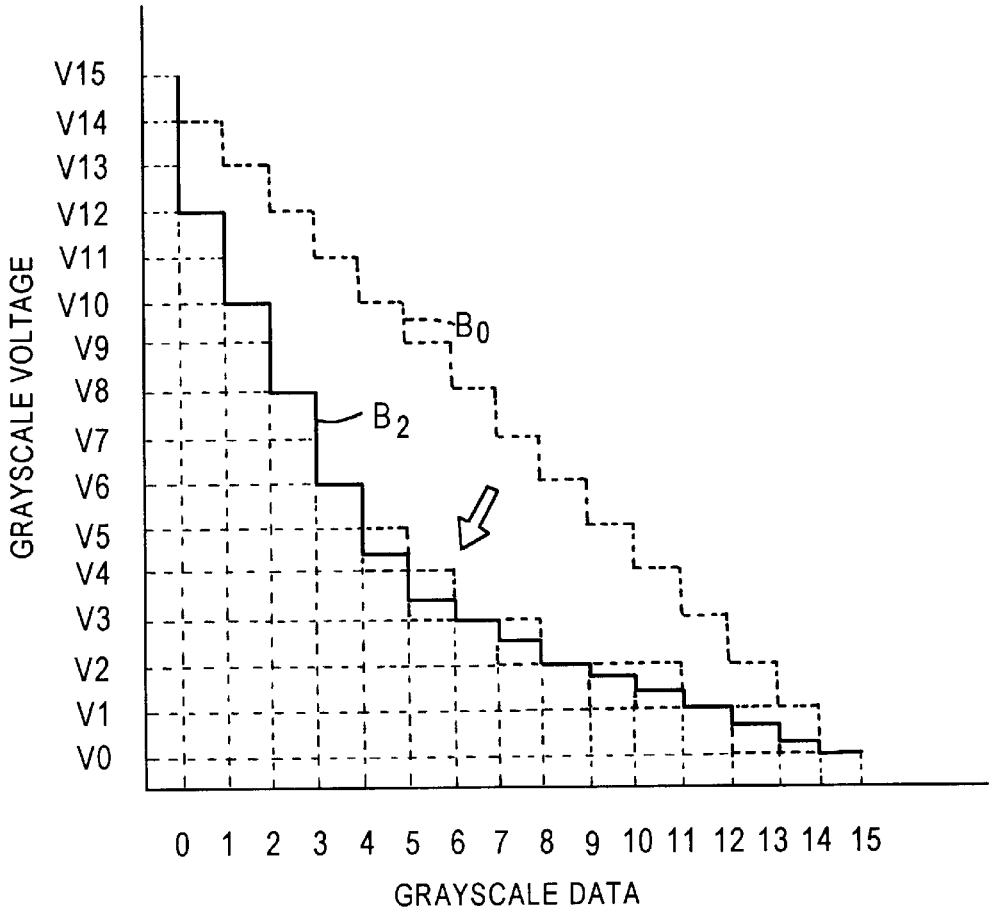
FIG. 5 is a data conversion table showing data conversion performed in a liquid crystal display according to a second embodiment of the invention.
FIG. 6 is a characteristic diagram showing the relationship between grayscale data and grayscale voltages of the liquid crystal display according to the second embodiment of the invention.

FIG. 5 is a data conversion table showing data conversion performed in a liquid crystal display according to a second embodiment of the invention.

FIG. 6 is a characteristic diagram showing the relationship between grayscale data and grayscale voltages of the liquid crystal display according to the second embodiment of the invention.

The second embodiment represents a method for conversion utilizing a data conversion circuit which is different from that in the first embodiment and, as shown in FIG. 5, data conversion is performed such that an arbitrary different grayscale voltage is selected for each frame or each group consisting of a plurality of frames.

FIG. 6 shows the data conversion as represented by the relationship between the grayscale data and grayscale voltages, and a conversion characteristic of a combination of an n-th frame, an (n+1)-th frame and an (n+2)-th frame is represented by B2. An arbitrary different grayscale voltage is selected for each frame or each group consisting of a plurality of frames to simulate display similar to display provided by an intermediate voltage which can not be generated by the grayscale voltage generation circuit.

Third Embodiment

Figure 7:
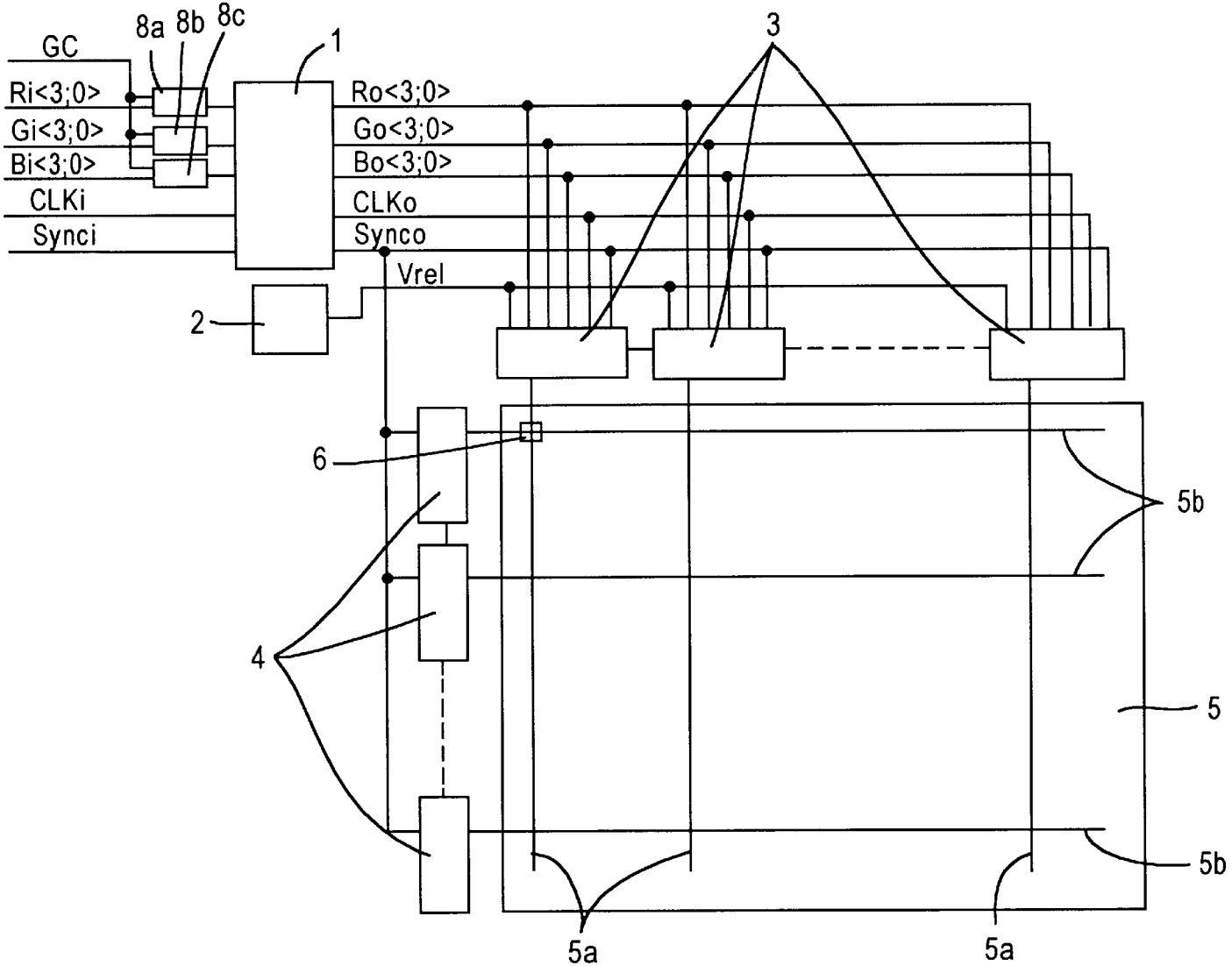
FIG. 7 is a circuit diagram of a liquid crystal display according to a third embodiment of the invention.
Figure 8:
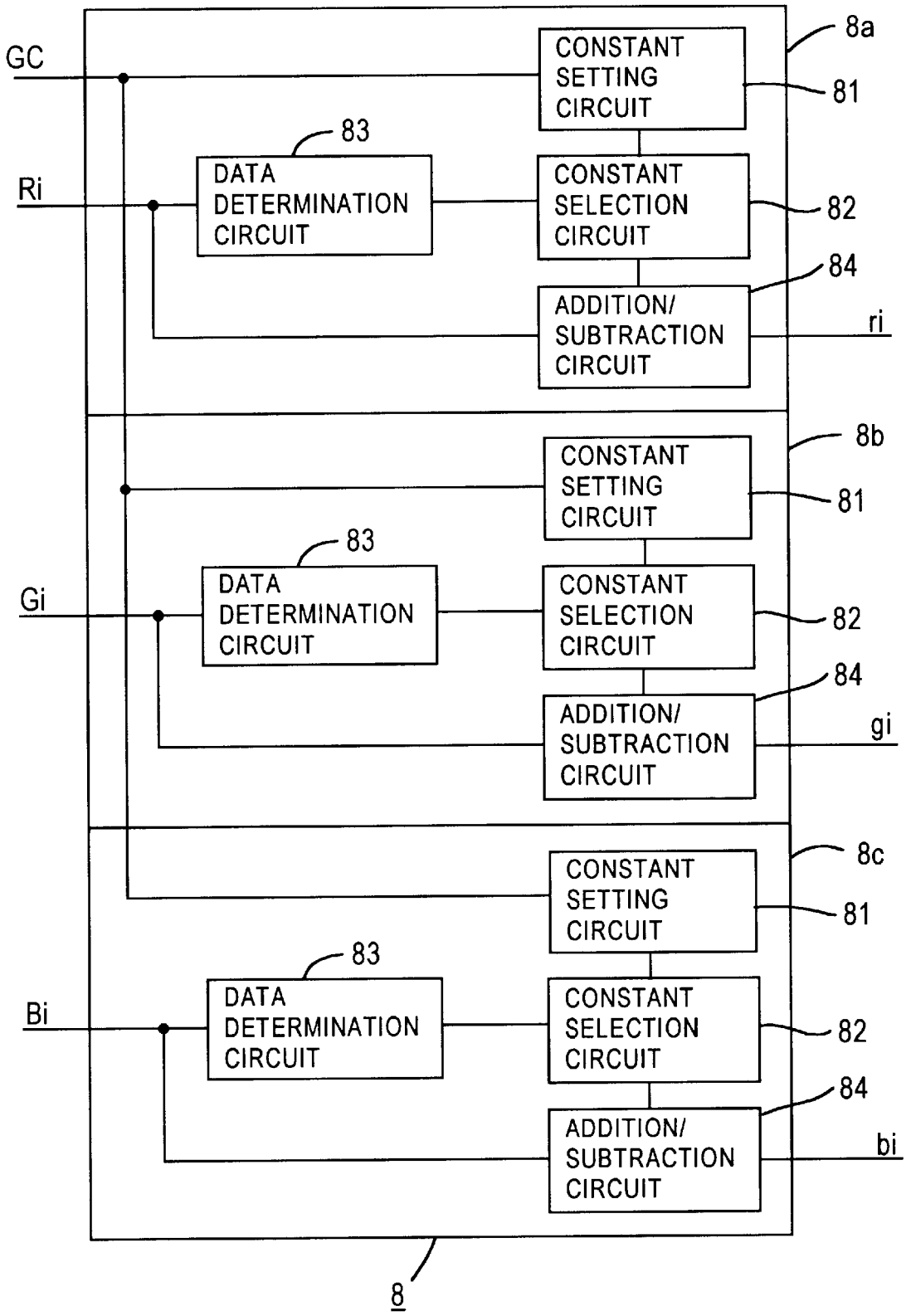
FIG. 8 is a block diagram of a specific example of data conversion circuits according to the third embodiment.

FIG. 7 is a circuit diagram of a liquid crystal display according to a third embodiment of the invention. In FIG. 7, reference numbers 1 through 6 represents parts identical to those in FIG. 1. Reference numbers 8*a*, 8*b* and 8*c* represent data conversion circuits which perform arbitrary data conversion on digital image data associated with R, G and B color signals, respectively. FIG. 8 is a block diagram of a specific example of the data conversion circuits 8*a*, 8*b* and 8*c* according to the third embodiment. The data conversion circuits 8*a*, 8*b* and 8*c* are respectively provided in association with color signal inputs Ri, Bi and Gi which are digital signals, and each of the data conversion circuits 8*a*, 8*b* and 8*c* has a constant setting circuit 81, a constant selection circuit 82, a data determination circuit 83 and an addition/subtraction circuit 84 similarly to the data conversion circuit 8 in FIG. 2.

Figure 9:
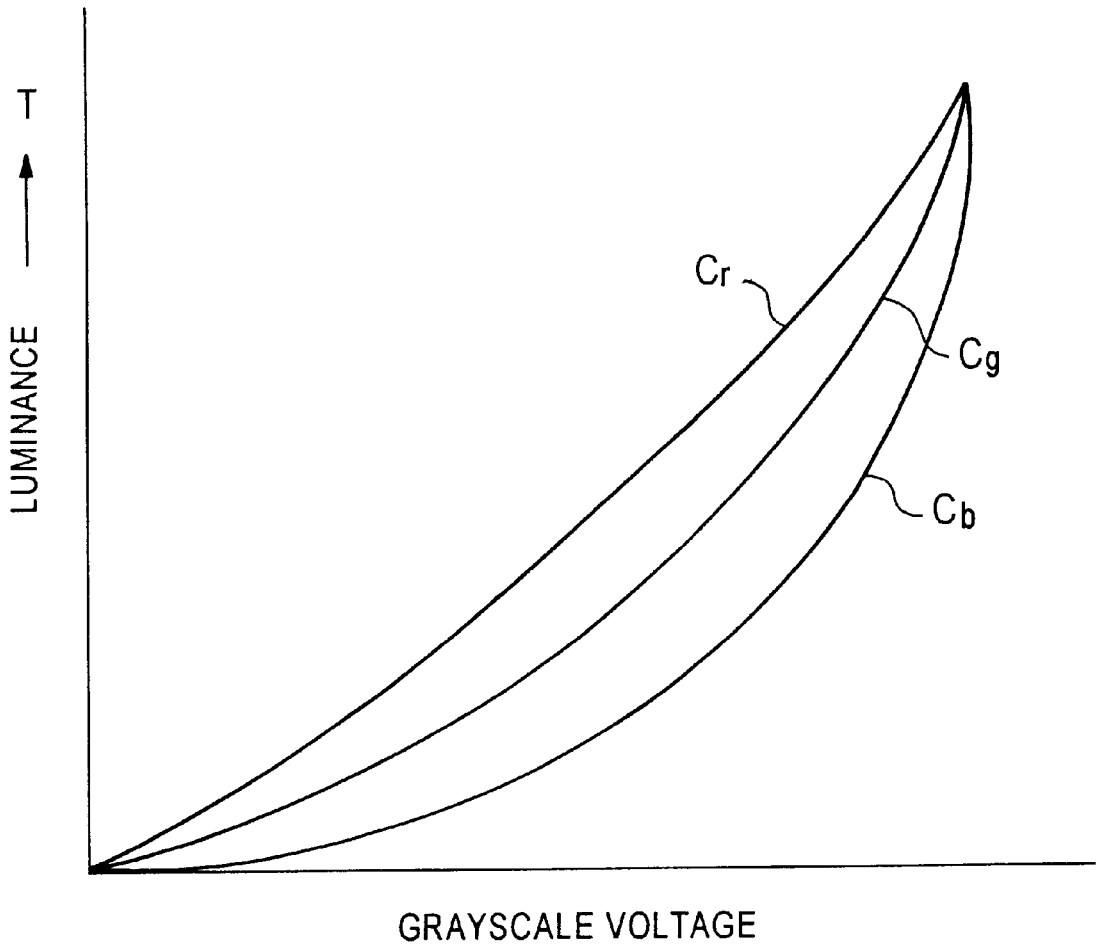
FIG. 9 is a characteristic diagram showing the relationship between grayscale data and luminance of the liquid crystal display according to the third embodiment of the invention.

According to the third embodiment, the conversion characteristics of the data conversion circuits 8*a*, 8*b* and 8*c*can be independently changed in association with the respective color signal inputs Ri, Bi and Gi to provide them with respective different grayscale characteristics. FIG. 9 is a characteristic diagram showing the relationship between grayscale data and luminance of the liquid crystal display according to the third embodiment of the invention, in which grayscale display characteristics respectively associated with the color signals Ri, Bi and Gi are represented by Cr, Cb and Cg.

Fourth Embodiment

Figure 10:
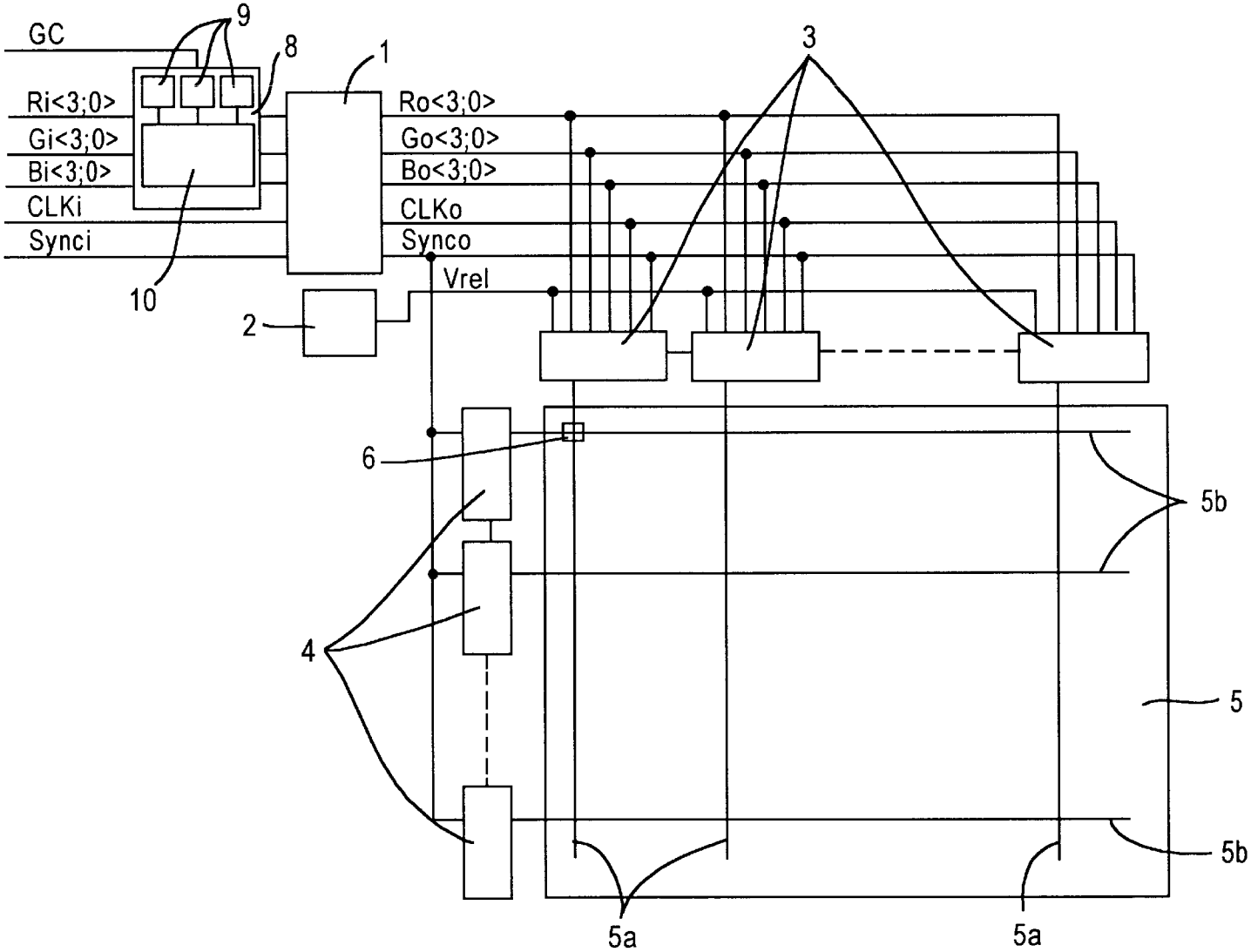
FIG. 10 is a circuit diagram of a liquid crystal display according to a fourth embodiment of the invention.
Figure 11:
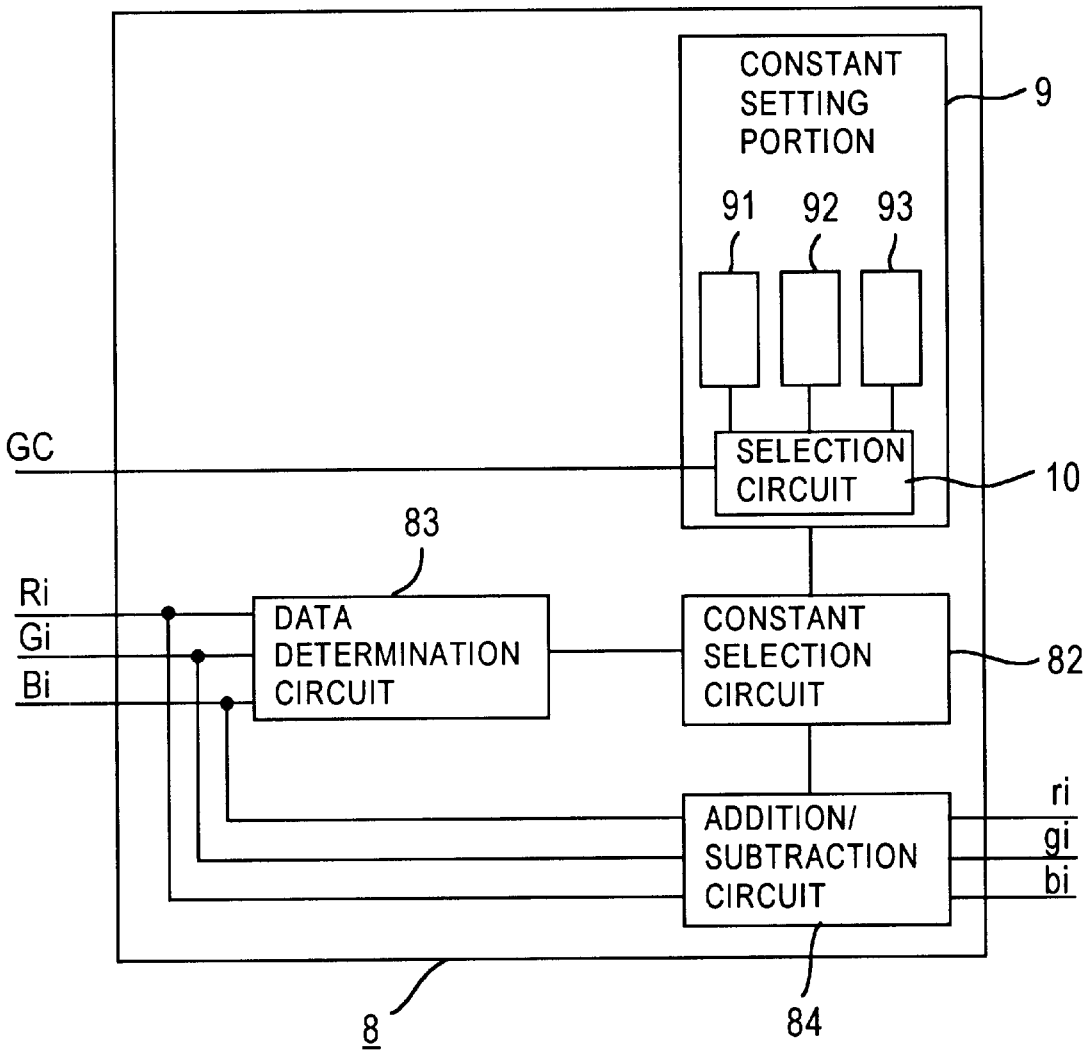
FIG. 11 is a block diagram of a specific example of a data conversion circuit according to the fourth embodiment.

FIG. 10 is a circuit diagram of a liquid crystal display according to a fourth embodiment of the invention, and FIG. 11 is a block diagram of a specific example of a data conversion circuit 8 thereof.

In FIG. 10, reference numbers 1 through 6 and 8 represent parts identical to those in FIG. 1. Reference number 9 represents data conversion algorithm defining circuits which define data conversion algorithm for the data conversion circuit 8. A plurality of data conversion algorithm defining circuits 91, 92 and 93 are provided, and each of them is constituted by, for example, a register similarly to the constant setting circuit 81. A selection circuit 10 selects one of the outputs of the data conversion algorithm defining circuits 91, 92 and 93, and the selected output is determined by a control signal GC.

In the fourth embodiment, the data conversion circuit 8 having the plurality of data conversion algorithm defining circuits 91, 92 and 93 and the selection circuit 10 selects one of a plurality of items of data conversion algorithm to change the grayscale display characteristic arbitrarily.

Fifth Embodiment

Figure 12:
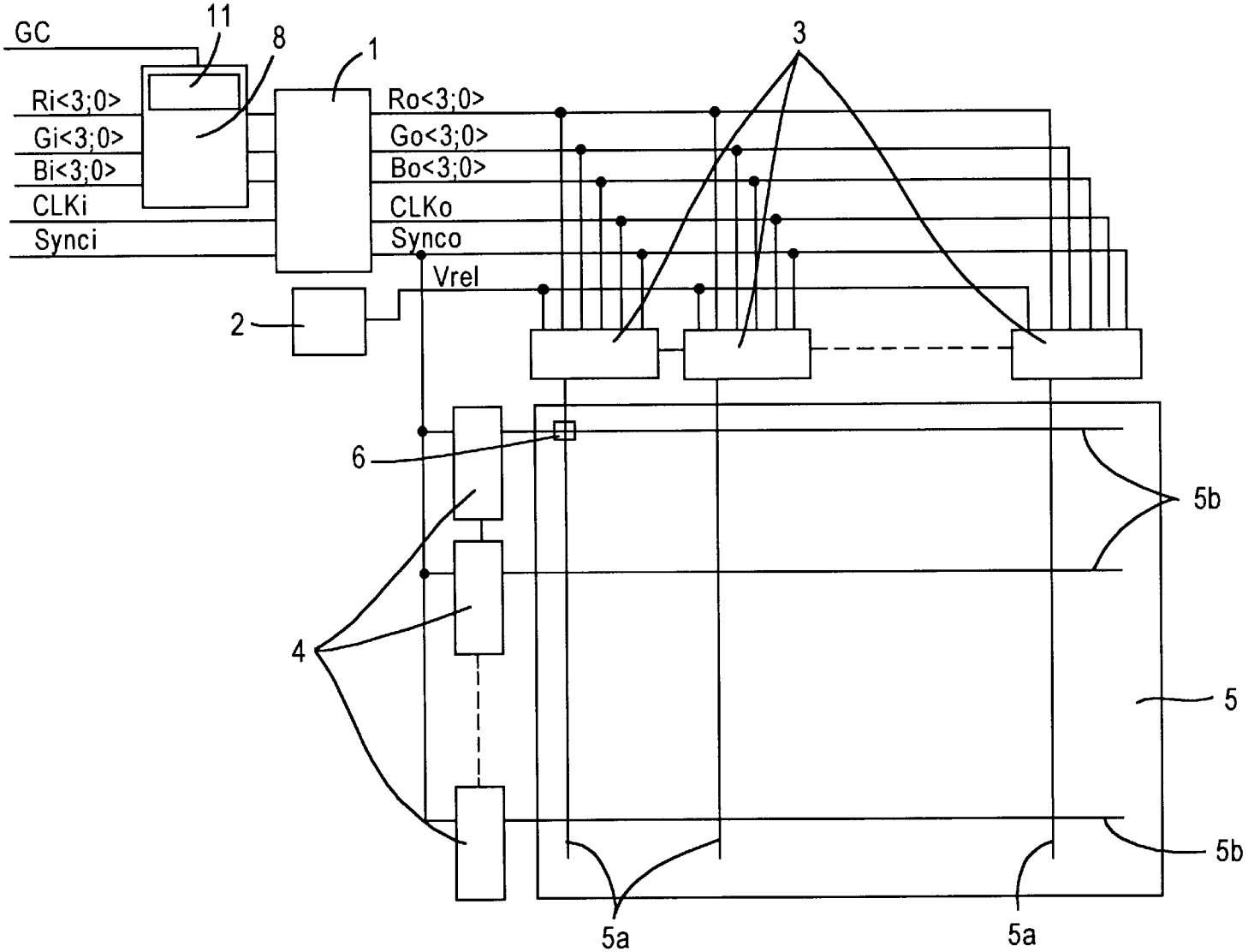
FIG. 12 is a circuit diagram of a liquid crystal display according to a fifth embodiment of the invention.
Figure 13:
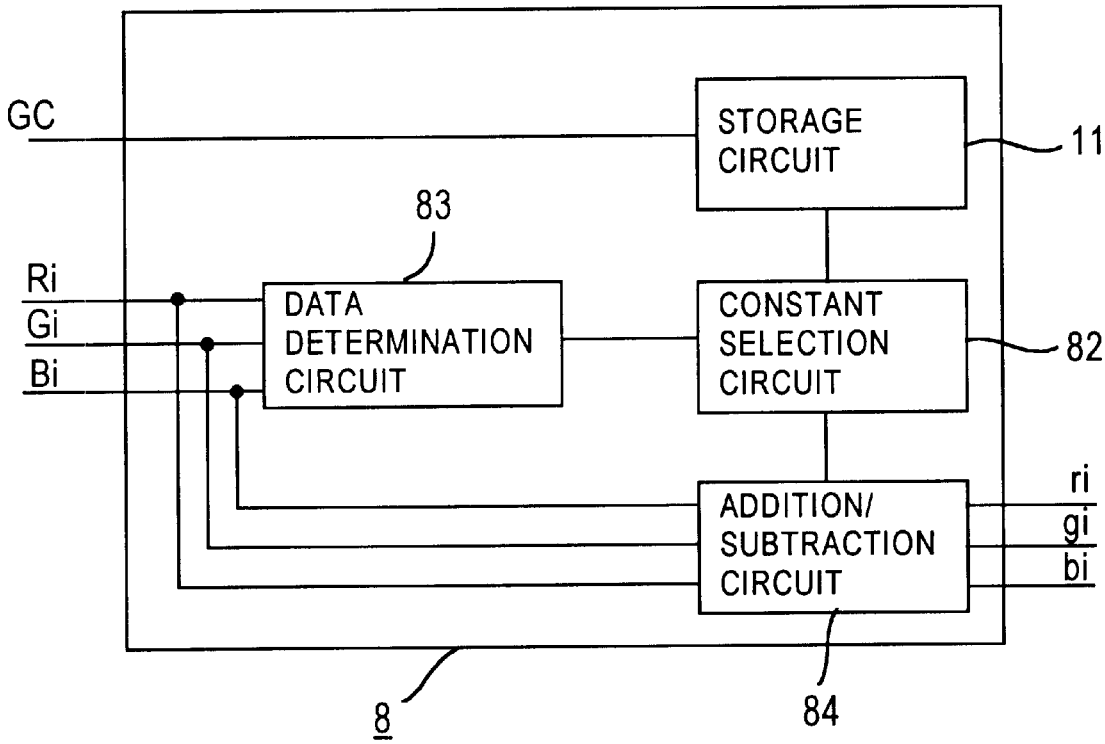
FIG. 13 is a block diagram of a specific example of a data conversion circuit according to the fifth embodiment.

FIG. 12 is a circuit diagram of a liquid crystal display according to a fifth embodiment of the invention, and FIG. 13 is a block diagram of a specific example of a data conversion circuit 8 thereof.

In FIG. 12, reference numbers 1 through 6 and 8 represent parts identical to those in FIG. 1. Reference number 11 represents a storage circuit that constitutes a storage portion for storing data conversion algorithm for the data conversion circuit 8.

In the fifth embodiment, the storage circuit 11 for storing data conversion algorithm is provided to allow the data conversion algorithm to be rewritten from the outside, thereby allowing the grayscale display characteristic to be changed arbitrarily.

Sixth Embodiment

Figure 14:
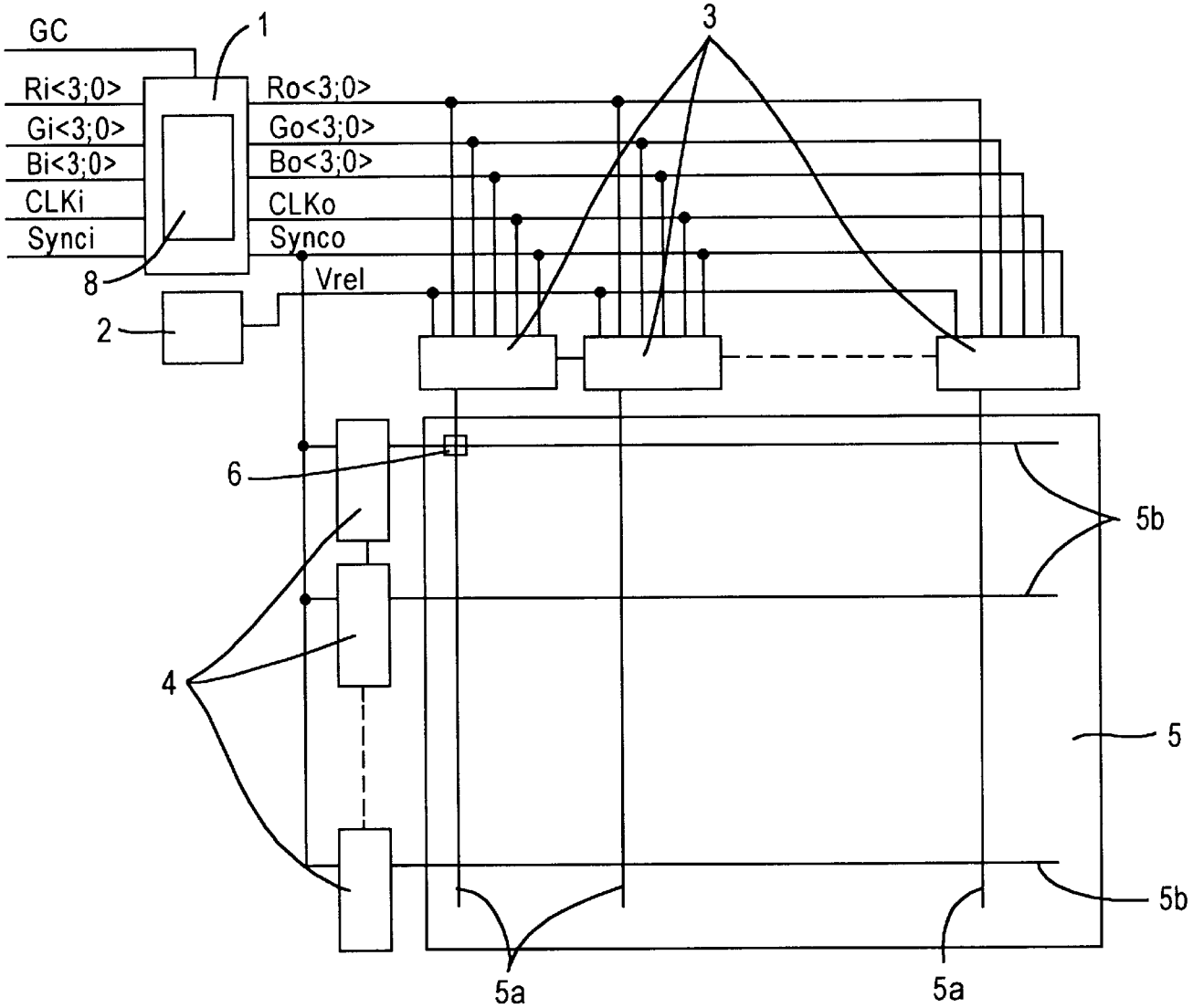
FIG. 14 is a circuit diagram of a liquid crystal display according to a sixth embodiment of the invention.
Figure 15:
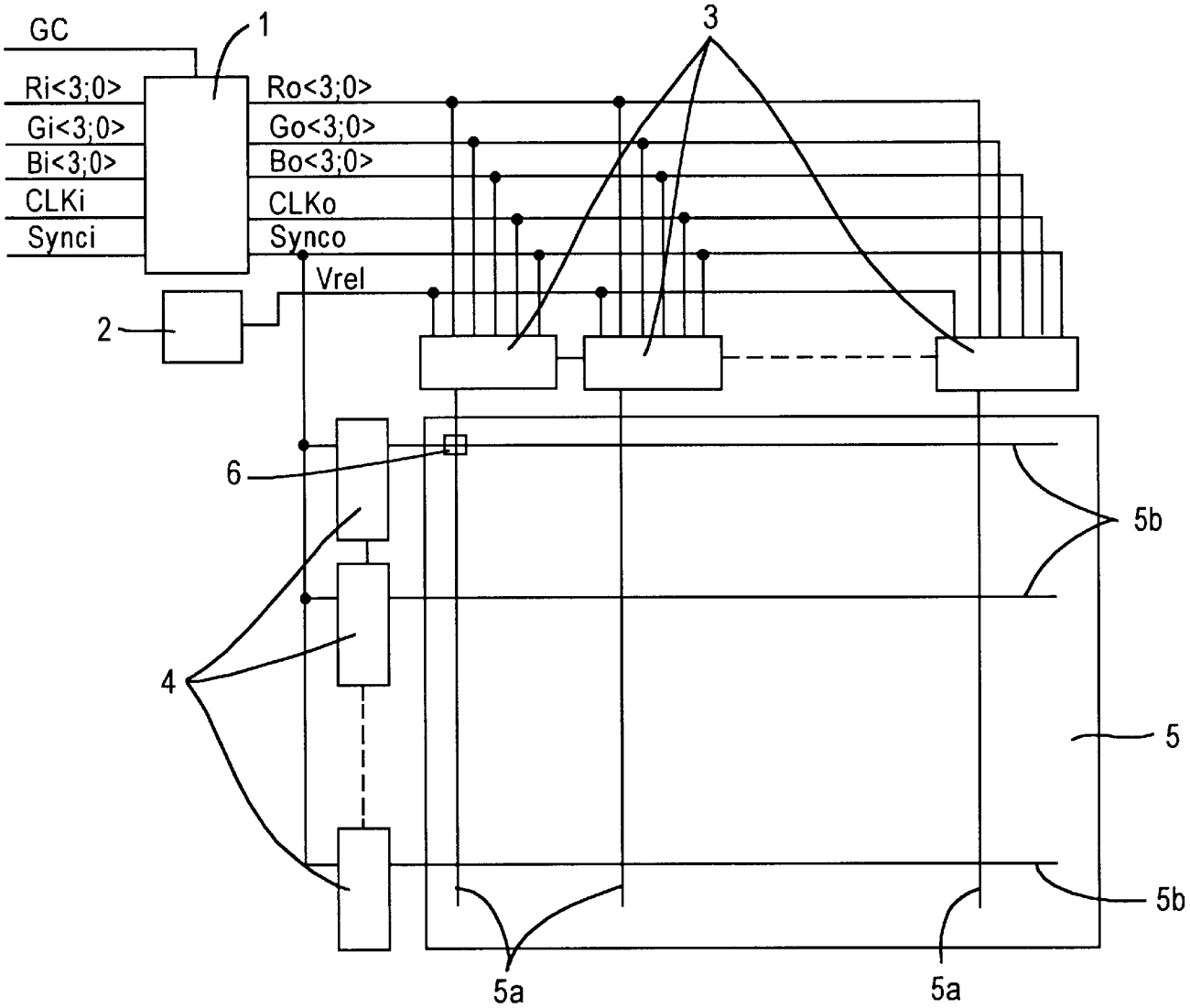
Fig. 15 (PRIOR ART)
FIG. 15 is a circuit diagram of a conventional liquid crystal display.
Figure 16:
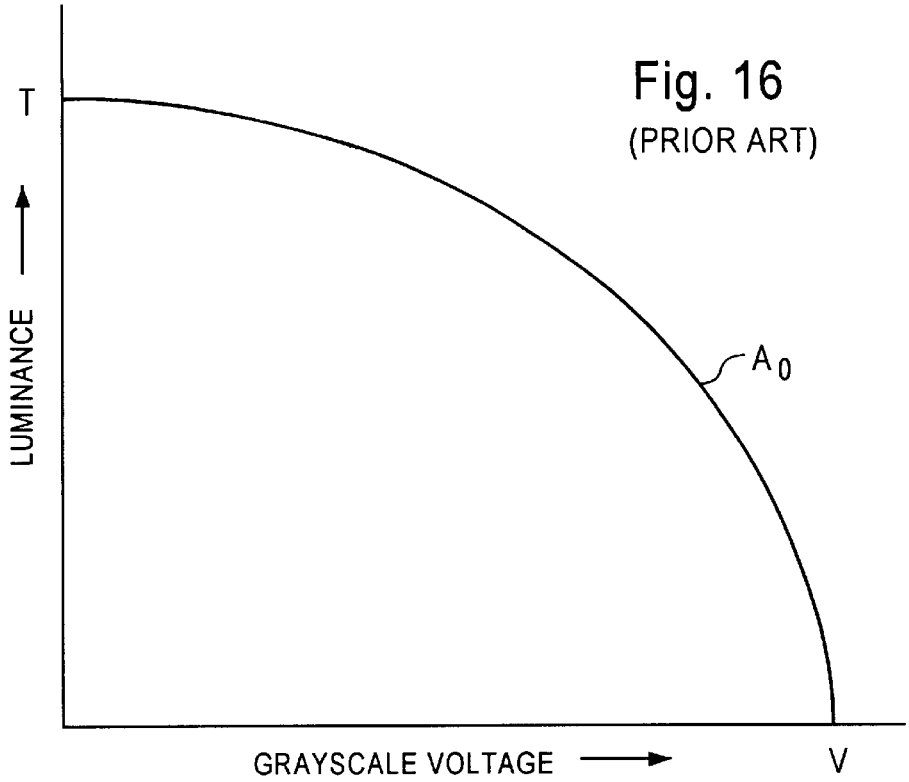
Fig. 16 (PRIOR ART)
FIG. 16 is a characteristic diagram showing the relationship between grayscale voltages and luminance of the conventional liquid crystal display.
Figure 17:
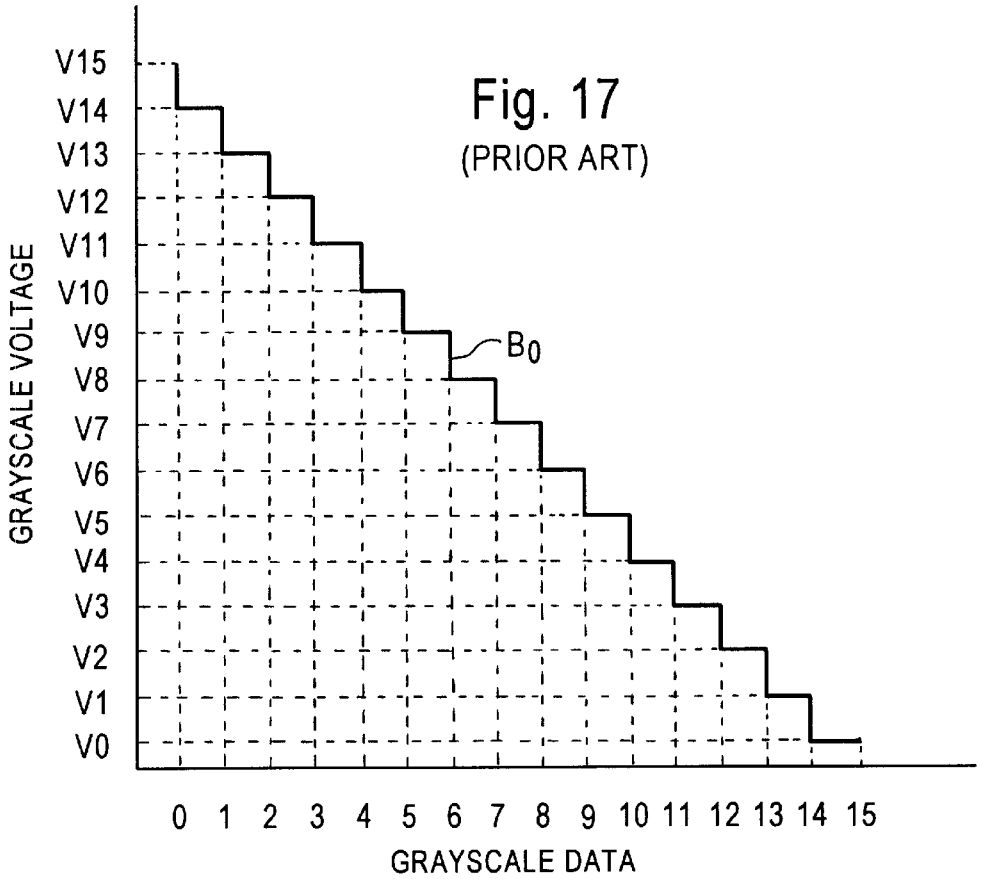
Fig. 17 (PRIOR ART)
FIG. 17 is a characteristic diagram showing the relationship between grayscale data and the grayscale voltages of the conventional liquid crystal display.
Figure 18:
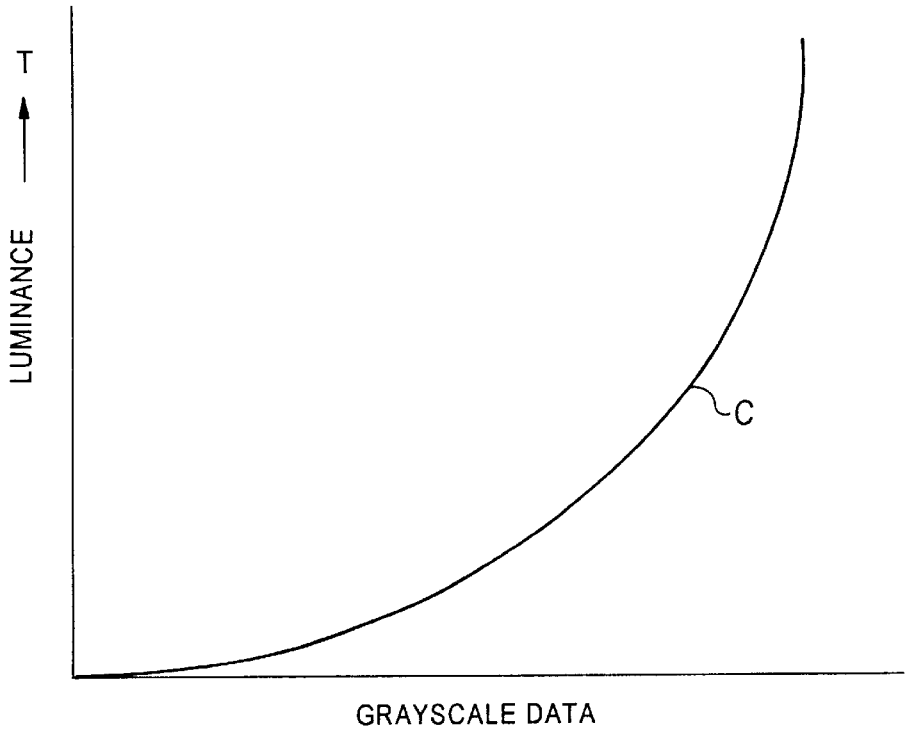
Fig. 18 (PRIOR ART)
FIG. 18 is a characteristic diagram showing the relationship between the grayscale data and luminance of the conventional liquid crystal display.
Figure 19:
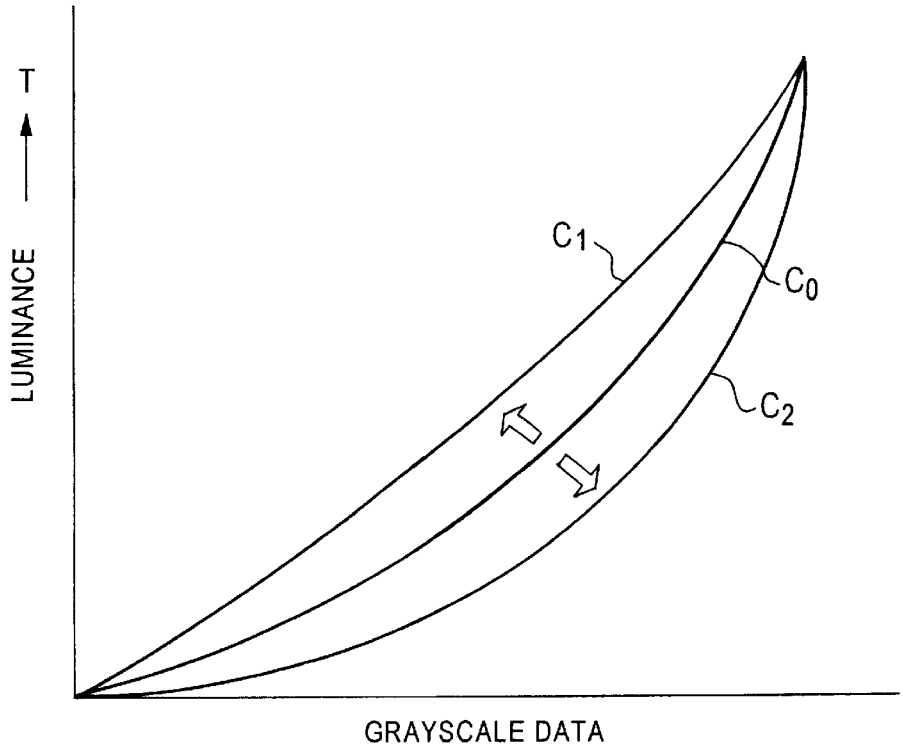
Fig. 19 (PRIOR ART)
FIG. 19 is a characteristic diagram showing an example of a modification of the relationship between the grayscale data and luminance of the conventional liquid crystal display.
Figure 20:
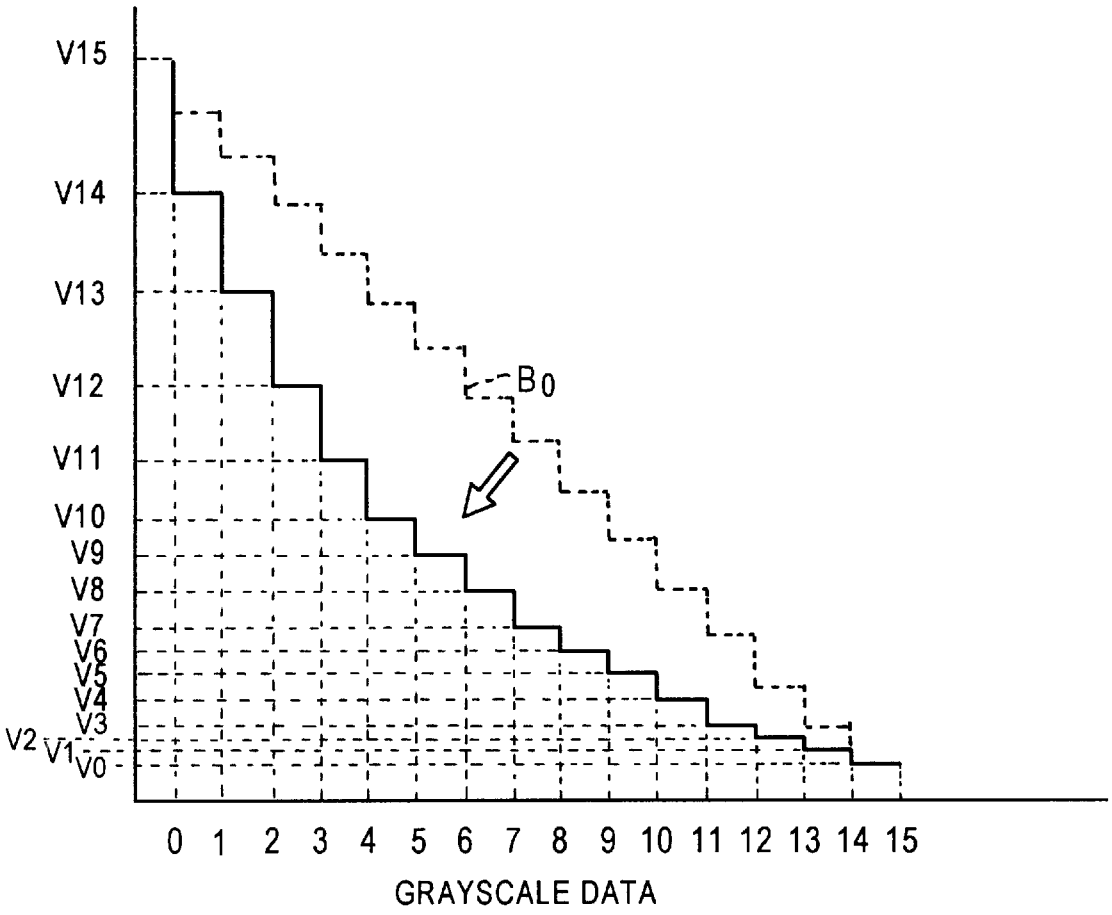
Fig. 20 (PRIOR ART)
FIG. 20 is a characteristic diagram showing the relationship between the grayscale data and grayscale voltages of the conventional liquid crystal display.
Figure 21:
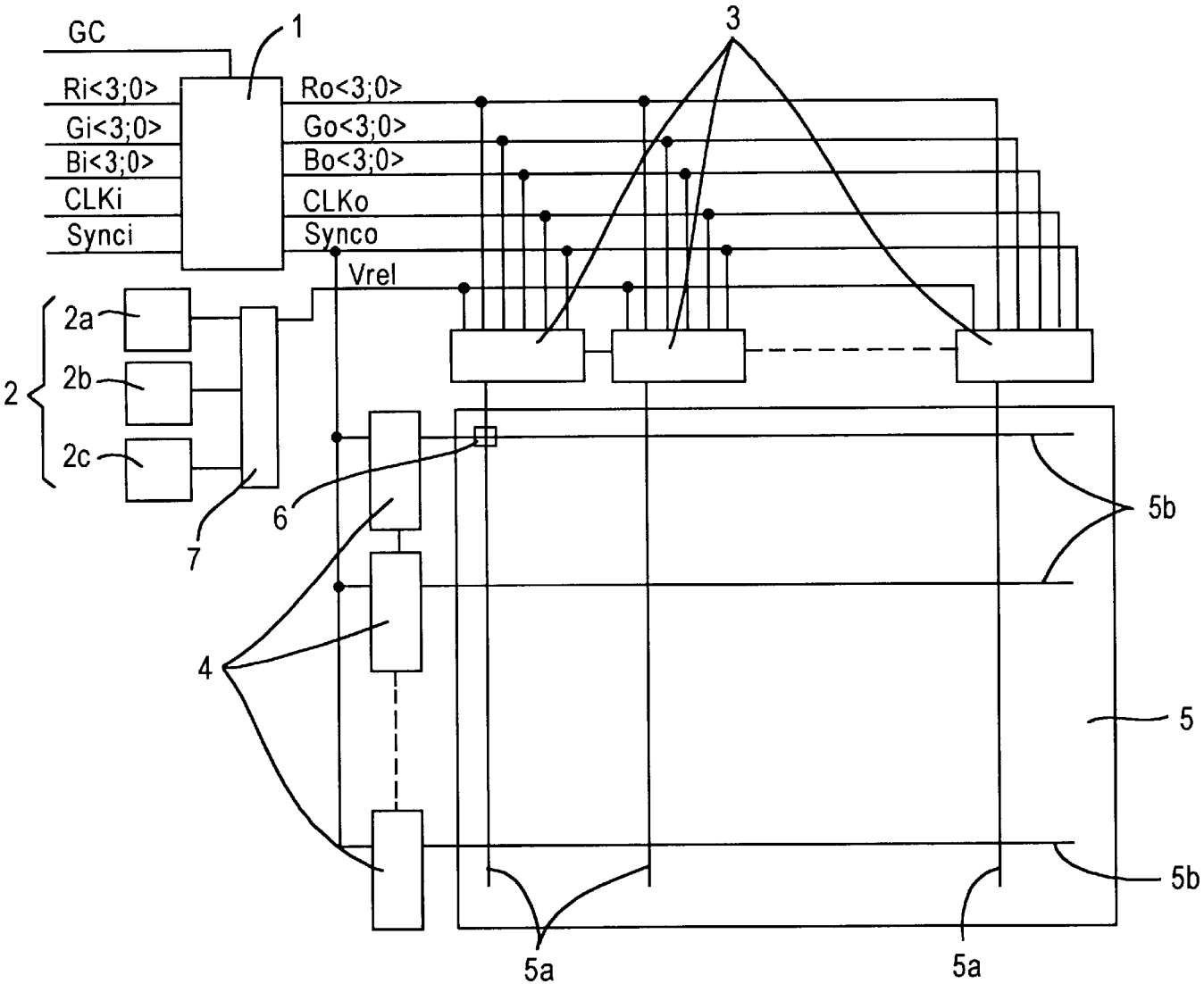
Fig. 21 (PRIOR ART)
FIG. 21 is a circuit diagram of another example of a conventional liquid crystal display.

FIG. 14 is a circuit diagram of a liquid crystal display according to a sixth embodiment of the invention.

In FIG. 14, reference numbers 1 through 6 and 8 represent parts identical to those in FIG. 1.

In the sixth embodiment, a data conversion circuit 8 is incorporated in a control signal generation circuit 1 constituted by, for example, an ASIC or the like to provide a simple circuit configuration.

Although the first to sixth embodiments use the color signal Ri, Gi, Bi, Ro, Go, Bo, ri, gi, bi having a 4-bit configuration, also can use the color signal having other plurarity bits configuration, such as 6-bit, 8-bit or 16-bit configuration.

The invention having the above-described configurations provides advantages as described below.

There is provided: a circuit which includes a data conversion circuit for converting digital image input data based on arbitrary algorithm and which outputs digital image output data based on the output of the data conversion circuit; a grayscale voltage generation circuit which outputs grayscale voltages at a plurality of levels; source driving circuits which receive the digital image output data and grayscale voltages and which select and output a grayscale voltage at one level from among the grayscale voltages in accordance with the digital image output data; and a display portion which is configured so as to display an image as a result of the application of the grayscale voltage output by the source driving circuits to a liquid crystal thereof. The data conversion circuit converts the digital image input data so as to change a grayscale display characteristic of the image displayed at the display portion. It is therefore possible to change the selection of grayscale voltages through the data conversion and to thereby change the grayscale display characteristic arbitrarily.

There is further provided a plurality of algorithm defining circuits each of which defines algorithm to be used in the data conversion circuit, and one of the plurality of algorithm defining circuits is selected and used by the data conversion circuit. This makes it possible to use algorithm which is suitable for changing of the grayscale display characteristic.

There is provided: a setting portion in which algorithm for converting first digital image data input from the outside into second digital image data is set; a data conversion circuit which uses the algorithm set in the setting portion to convert the first digital image data into the second digital image data; a control signal generation circuit to which the second digital image data converted by the data conversion circuit are input and which outputs the second digital image data and a control signal; a grayscale voltage generation circuit which outputs grayscale voltages at a plurality of levels; source driving circuits to which the second digital image data and control signal output by the control signal generation circuit and the grayscale voltages at a plurality of levels output by the grayscale voltage generation circuit are input, which select a grayscale voltage at one level from among the grayscale voltages at a plurality of levels in accordance with the second digital image data and which output the same in accordance with the control signal; and a display portion which is configured so as to display an image as a result of the application of the grayscale voltage output by the source driving circuits to a liquid crystal thereof. The data conversion circuit converts the first digital image data into the second digital image data so as to change a grayscale display characteristic of the image displayed at the display portion.

A plurality of items of algorithm are set in the setting portion, and the data conversion circuit selects one of the plurality of items of algorithm to perform data conversion. This makes it possible to use algorithm which is suitable for changing of the grayscale display characteristic.

Further, since the setting portion is configured so as to allow rewriting of the algorithm from the outside, the algorithm can be rewritten when needed.

Furthermore, since the data conversion circuit converts data in each frame or each group consisting of a plurality of frames, it is possible to simulate display similar to display provided by a voltage which resides between grayscale voltages generated by the grayscale voltage generation circuit.

The digital image data are constituted by red, green and blue color signals, and the data conversion circuit performs data conversion on each of the red, green and blue color signals. This makes it possible to change the grayscale display characteristic of each color.

In addition, the data conversion circuit is incorporated in an integrated circuit that constitutes the control signal generation circuit. This makes it possible to provide a simple circuit configuration.

What is claimed is:

1. A liquid crystal display comprising:

a data conversion circuit for converting input-digital image data having different values representing different grayscale voltages to converted digital image data based on an arbitrary algorithm;

a source driving circuit that receives the converted digital image data and outputs grayscale voltages with different potential levels according to each different value of converted digital image data;

a grayscale voltage generation circuit which outputs said grayscale voltages with different potential levels, and supplies the different potential levels to said source driving circuit; and a display portion which is configured so as to display an image that includes grayscale levels based on said grayscale voltages from said source driving circuit.

2. A liquid crystal display according to claim 1, further comprising a plurality of algorithm defining circuits each of which defines algorithm to be used in the data conversion circuit, wherein one of said plurality of algorithm defining circuits is selected and used by the data conversion circuit.

3. A liquid crystal display according to claim 1, wherein the data conversion circuit converts data in each frame or each group consisting of a plurality of frames.

4. A liquid crystal display according to claim 1, wherein the digital image data are constituted by red, green and blue color signals and wherein the data conversion circuit performs data conversion on each of the red, green and blue color signals.

5. A liquid crystal display according to claim 1, wherein the data conversion circuit is incorporated in an integrated circuit that constitutes the control signal generation circuit.

6. A liquid crystal display comprising:

a setting portion in which an algorithm for converting first digital image data input from the outside into second digital image data is set;

a data conversion circuit which uses the algorithm set in the setting portion to convert the first digital image data into the second digital image data;

a control signal generation circuit to which the second digital image data converted by the data conversion circuit are input and which outputs said second digital image data and a control signal;

a grayscale voltage generation circuit which outputs grayscale voltages at a plurality of levels with different potential levels to each other;

a source driving circuit to which the second digital image data and control signal output by said control signal generation circuit and the grayscale voltages with different potential levels output by said grayscale voltage generation circuit are input, which selects a grayscale voltage at one potential level from among said grayscale voltages with different potential levels in accordance with the second digital image data and which outputs the same in accordance with said control signal; and a display portion which is configured so as to display an image that includes grayscale levels based on said grayscale voltages output by the source driving circuit to a liquid crystal thereof;

wherein said data conversion circuit converts the first digital image data into the second digital image data so as to change a grayscale display characteristic of the image displayed at said display portion.

7. A liquid crystal display according to claim 6, wherein a plurality of items of algorithm are set in the setting portion and wherein the data conversion circuit selects one of said plurality of items of algorithm to perform data conversion.

8. The liquid crystal display of claim 6, wherein the setting portion is configured so as to allow rewriting of the algorithm from the outside.

9. A liquid crystal display comprising:

a setting portion in which an algorithm for converting first digital image data input from the outside into second digital image data is set;

a data conversion circuit which uses the algorithm set in the setting portion to convert the first digital image data into the second digital image data;

a control signal generation circuit to which the second digital image data converted by the data conversion circuit are input, and from which said control signal generation circuit outputs said second digital image data and a control signal;

a grayscale voltage generation circuit which outputs grayscale voltages with different potential levels to each other;

a source driving circuit to which the second digital image data and control signal output by said control signal generation circuit and the grayscale voltages with different potential levels output by said grayscale voltage generation circuit are input, which selects a grayscale voltage at one level from among said grayscale voltages with different potential levels in accordance with the second digital image data and which outputs the same in accordance with said control signal; and a display portion which is configured so as to display an image including grayscale levels based on said grayscale voltage output by said source driving circuit to a liquid crystal thereof;

wherein said data conversion circuit converts the first digital image data into the second digital image data so as to change a grayscale display characteristic of the image displayed at said display portion; and wherein the setting portion is configured so as to allow rewriting of the algorithm from the outside.

10. A liquid crystal display comprising:

a circuit which includes a data conversion circuit for converting digital image input data based on arbitrary algorithm, and which outputs digital image output data based on the output of the data conversion circuit;

a grayscale voltage generation circuit which outputs grayscale voltages at a plurality of levels;

a source driving circuit which receives said digital image output data and grayscale voltages which selects and outputs a grayscale voltage at one level from among said grayscale voltages in accordance with said digital image output data; and a display portion which is configured so as to display an image as a result of the application of the grayscale voltage output by the source driving circuit to a liquid crystal thereof, said data conversion circuit converting said digital image input data so as to change a grayscale display characteristic of the image displayed at said display portion, a plurality of algorithm defining circuits each of which defines a separate algorithm to be used in the data conversion circuit, wherein one of said plurality of algorithm defining circuits is selected and used by the data conversion circuit.

11. A liquid crystal display comprising:

a setting portion in which algorithm for converting first digital image data input from the outside into second digital image data is set;

a data conversion circuit which uses the algorithm set in the setting portion to convert the first digital image data into the second digital image data;

a control signal generation circuit to which the second digital image data converted by the data conversion circuit are input and which outputs said second digital image data and a control it signal;

a grayscale voltage generation circuit which outputs grayscale voltages at a plurality of levels;

a source driving circuit to which the second digital image data and control signal output by said control signal generation circuit and the grayscale voltages at a plurality of levels output by said grayscale voltage generation circuit are input, which selects a grayscale voltage at one level from among said grayscale voltages at a plurality of levels in accordance with the second digital image data and which outputs the same in accordance with said control signal; and a display portion which is configured so as to display an image as a result of the application of the grayscale voltage output by the source driving circuit to a liquid crystal thereof, said data conversion circuit converting the first digital image data into the second digital image data so as to change a grayscale display characteristic of the image displayed at said display portion;

wherein a plurality of items of algorithm are set in the setting portion and wherein the data conversion circuit selects one of said plurality of items of algorithm to perform data conversion.

* * * * *